US007493924B2

(12) United States Patent
Garcia et al.

(10) Patent No.: US 7,493,924 B2
(45) Date of Patent: Feb. 24, 2009

(54) APPARATUS AND METHOD FOR MAKING AN IMPROVED CHAIN LINK FABRIC

(75) Inventors: Jose G. Garcia, La Puente, CA (US); Scott C. Barsotti, Santa Monica, CA (US)

(73) Assignee: Bergandi Machinery Company, Mira Loma, CA (US)

( * ) Notice: Subject to any disclaimer, the term of this patent is extended or adjusted under 35 U.S.C. 154(b) by 695 days.

(21) Appl. No.: 11/131,771

(22) Filed: May 17, 2005

(65) Prior Publication Data

US 2005/0263564 A1 Dec. 1, 2005

Related U.S. Application Data

(63) Continuation-in-part of application No. 10/350,142, filed on Jan. 22, 2003, now abandoned.

(51) Int. Cl.
*B21F 27/14* (2006.01)

(52) U.S. Cl. ..... 140/92.7; 140/3 R; 140/24; 228/192; 245/10

(58) Field of Classification Search ..... 228/15.1, 228/49.1, 141.1, 173.1, 173.5, 192; 140/3 A, 140/51, 24, 107, 111; 256/45
See application file for complete search history.

(56) References Cited

U.S. PATENT DOCUMENTS

| | | | | |
|---|---|---|---|---|
| 444,753 | A | 1/1891 | Kitschman | |
| 857,156 | A | 6/1907 | Cameron | |
| 873,195 | A | 12/1907 | Willets | |
| 889,815 | A | 6/1908 | Sohmid | |
| 991,542 | A | 5/1911 | Rochrich | |
| 1,005,480 | A | 10/1911 | Schmid | |
| 1,243,353 | A | 10/1917 | Snedeker | |
| 1,259,378 | A | 3/1918 | Doring | |
| 1,811,511 | A | 6/1931 | Mafera | |
| 1,847,155 | A | 3/1932 | Williams | |
| 1,885,361 | A | 11/1932 | Land | |
| 2,202,442 | A | 5/1940 | Blashill | |
| 2,447,155 | A | 8/1948 | Brickman | |
| 2,610,009 | A | 9/1952 | Mafera | |
| 2,843,160 | A | 7/1958 | Blashill | |
| 3,144,887 | A | 8/1964 | Bergandi | |
| 3,388,725 | A | 6/1968 | Richardson | |
| 3,601,163 | A | 8/1971 | Ellis | |
| 3,722,554 | A | 3/1973 | Vanderfaeillie | |
| 4,211,068 | A * | 7/1980 | Lange | 59/31 |

(Continued)

*Primary Examiner*—Kiley Stoner
*Assistant Examiner*—Devang Patel
(74) *Attorney, Agent, or Firm*—Greenberg Traurig LLP

(57) ABSTRACT

An apparatus for processing chain link fabric including a welding assembly and/or a compressing assembly. The welding assembly is configured to weld together wire-end portions of the chain link fabric. The welding assembly includes a guiding assembly having a finger and a cam, which are configured to restrict the movement of the wire-end portions while the welding assembly welds them together. The finger and the cam are configured to move relative to the wire-end portions both before and after the wire-end portions are welded together. The compressing assembly is configured to compress the wire-end portions after they are welded together. The compressing assembly includes a stabilizing assembly having a stabilizing die, which is configured to interface with the chain link fabric and to restrict the movement of the welded wire-end portions while the compressing assembly compresses the welded wire-end portions.

5 Claims, 13 Drawing Sheets

U.S. PATENT DOCUMENTS 4,372,350 A * 2/1983 Schmidt et al. ..... 140/112
4,513,793 A 4/1985 Rohrbacher
4,566,501 A 1/1986 Rohrbacher
4,572,249 A 2/1986 Lange
5,354,036 A 10/1994 Brown
5,592,978 A 1/1997 Garcia et al.
5,778,655 A * 7/1998 Lange ..... 59/31
5,785,097 A 7/1998 Garcia
5,908,052 A 6/1999 Garcia

* cited by examiner

FIG. 5
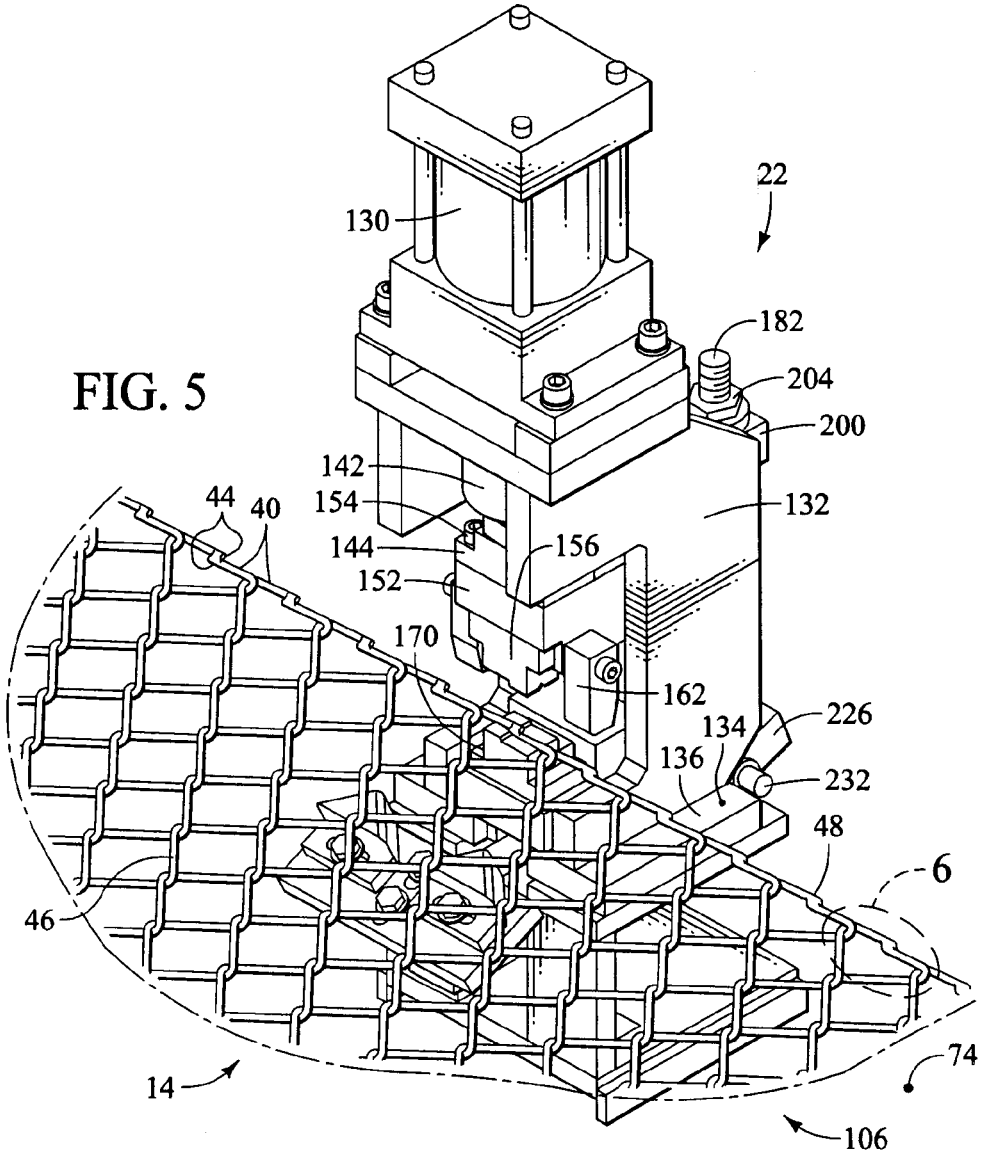
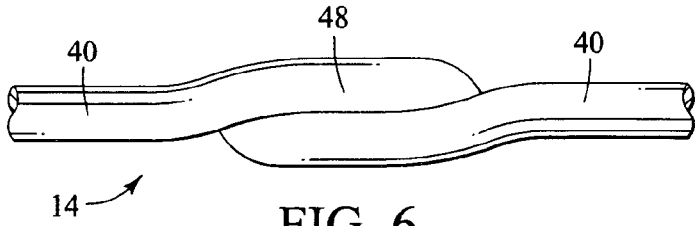
FIG. 6

APPARATUS AND METHOD FOR MAKING AN IMPROVED CHAIN LINK FABRIC

CROSS-REFERENCE TO RELATED APPLICATION

This is a continuation-in-part application of U.S. patent application Ser. No. 10/350,142, filed on Jan. 22, 2003, now abandoned entitled: "METHOD AND APPARATUS FOR MAKING AN IMPROVED CHAIN LINK FABRIC," by Jose G. Garcia and Scott C. Barsotti, which application is incorporated by reference herein.

BACKGROUND OF THE INVENTION

1. Field of the Invention

The present invention relates generally to chain link fabrics and, more particularly, to an improved chain link fabric with flattened ends and a method and apparatus for forming the flattened ends of the fabric.

2. Description of the Related Art

It has been estimated that throughout the world, millions of square feet of chain link fabric are produced and sold annually. Recognizing the importance of providing effective and durable chain link fabric, the American Society for Testing and Materials (ASTM) has established minimum quality standards for both residential and commercial chain link fabric. Realizing that chain link fabric can be effective for various different applications, the fencing and chain link industry has developed many different types of chain link fabric. Each type of chain link fabric has specific features that provide additional advantages when the fabric is used for its intended purpose.

Typically, chain link fabric is used as a barrier. When it is used as a barrier, it is typically used with some type of support member, such as a fence frame, that holds the fabric in place. Also, chain link fabric commonly is used to control or prevent the movement of nearby objects. For example, chain link fabric often is used in land fills and mines, and on land to control rocks, boulders, and soil.

Traditionally, chain link fabric is produced using a weaving machine. A typical weaving machine continually feeds two strands of wire into a weaving blade and trough mechanism that bends and weaves the two wires together. The weaving blade and trough interweave the two wires by helically winding them to provide a continuous mesh, without knots or ties, except possibly at the edges of the finished fabric. After being woven together, the formed continuous links of chain link fabric are cut off at the edges, leaving sharp wire-end portions. How the edges of the fabric are finished is generally referred to as the selvage. Typically, the selvage is knuckled or barbed depending on the intended use of the chain link fabric. If a knuckled edge is desired, typically, an assembly on the weaving machine bends the sharp wire-end portions of the fabric over one another, forming a knuckle at the edge of the chain link fabric. Similarly, if a barbed edge is desired, typically, an assembly on the weaving machine twists the sharp wire-end portions creating a sharp barb at the edge of the chain link fabric.

Forming a chain link fabric having the characteristics, and using the method, described above has certain drawbacks. One such drawback is that knuckled or barbed ends are weak and easily can be crushed or bent out of place. When someone or something comes into contact with the barbed or knuckled ends of chain link fabric, the ends may be crushed or bent out of place. Either way, the damage may be so severe that the fabric must be repaired or replaced.

Additionally, if the ends of the fabric protrude because they have been bent out of place, the fabric has an undesirable, if not unsightly appearance. The protruding ends of the fabric are also more likely to cause injury because individuals passing by are more likely to come into contact with them. The protruding ends can poke individuals who do not notice them, causing serious injury.

Sometimes, individuals who encounter a fence will try to get around it by climbing it. The protruding ends of a damaged chain link fabric can poke an individual trying to climb the fence in a sensitive area, for example, the eye, or catch on to the individual's clothing as he is climbing the fence, causing the individual to fall and be seriously injured. The additional risk of injury and the undesirable appearance that results when the barbed and knuckled ends of the fabric are damaged can result in additional time being spent and expenses being incurred to repair or replace the damaged chain link fabric.

Another drawback of the chain link fabric described above, is the difficulty associated with shipping, installing, and removing it. Typically, after the fabric has been woven and the selvage has been formed, the fabric leaves the weaving machine and it is rolled into a compacted form that is useful for shipping. The chain link fabric is usually compacted by rolling the fabric so that the diamonds of the fabric collapse into each other to form a relatively tight and small roll of fabric. However, the knuckled or barbed ends of these compacted rolls usually become tangled in the rest of the chain link fabric, causing the ends to be bent out of place or pulled apart.

Alternatively, if the fabric is attached to a fence frame or other type of support member, when separate frames are placed close to one another the knuckled and barbed ends of the different chain link fabrics can get tangled together and pulled apart. The damaged ends of the fabric may require repair, resulting in additional time being spent and expenses being incurred. Additionally, individuals who install and repair the fabric are exposed to the additional risk of being seriously injured by the sharp barbed and knuckled ends that must be untangled, repaired, and installed.

Although there are known types of fence fabric, which might be categorized as having flattened end portions, these fabrics also have certain disadvantages. One such disadvantage is that many of these fabrics, such as gabion, are made of a very light gauge wire (typically 9 to 11 gage), which cannot be an effective permanent barrier and is more expensive to use. The flattened end portions of fabrics, other than gabion, typically are not strong enough to resist large forces, (e.g., an individual climbing onto the fabric) without bending or crushing. Even though a ¼" rod is sometimes use to strengthen the fabric, the rod usually does not provide enough strength to allow the fabric to resist large forces. Typically, chain link fabrics are used in environments where a substantial number of people or animals are nearby. Some of these people or animals will exert a large force on the chain link fabric by trying to climb over it or go under it. Therefore, through regular use, these fabrics usually experience a large amount of force at some time during their useful life. As a result, these fabrics usually are crushed or bent when a large force is exerted on them. The bent or crushed fabric must then be repaired or replaced resulting in additional time being spent and expenses being incurred.

Yet another disadvantage associated with chain link fabrics that might be categorized as having flattened end portions is that they often have protrusions and sharp edges at the ends of the adjoined wire-end portions resulting from a straight cut that can cause serious injury. More specifically, the flattened end portions are typically butt welded together, i.e., the ends of the flattened end portions are aligned with one another, without overlapping, during the welding process, or lap welded together, i.e., the flattened end portions overlap one another during the welding process, in a manner that leaves sharp edges and protrusions that are dangerous. Over an extended period of time, these protrusions and sharp edges can result in serious injury to numerous individuals. This is especially true when the individuals nearby do not see the protrusions, or do not appreciate the harm that they can cause (e.g., harm to small children and young adults). Therefore, fabrics having sharp edges and protrusions create an increased risk of injury when they are located near schools or in other areas where large numbers of children likely are to be present.

Accordingly, there exists a need for an improved chain link fabric that has strong, flattened end portions configured to withstand large forces without bending or crushing, and does not pose a serious risk of injury to installers and others that come into contact with it. There also is a need for chain link fabric that quickly can be prepared for transportation and easily installed, and that has an improved aesthetic appearance that lasts. Additionally, there exists a need for a method and apparatus for efficiently making the flattened end portions of the improved chain link fabric. The present invention fulfills these needs.

SUMMARY OF THE INVENTION

Briefly, and in general terms, the present invention resides in an improved chain link fabric having flattened end portions, and an apparatus and related methods for forming the flattened end portions. Advantageously, the present invention provides a chain link fabric with strong flattened end portions that do not pose the risk of serious harm to installers or individuals who come into contact with the flattened end portions. The flattened end portions of the present invention can withstand large amounts of force without being bent or pulled apart. Additionally, the chain link fabric can be quickly and easily prepared for shipping and installation without the end portions tangling. The improved chain link fabric of the present invention also eliminates the need for a tension wire, top rail, crimping wire or its equivalent because the flattened end portions serve as a continuous wire that creates tension in the fabric. Eliminating the need for these types of wires reduces the total cost of the fabric and the time required to install and repair the fabric, and provides for a more aesthetically pleasing fabric.

More specifically, by way of example and not limitation, the present invention resides in embodiments of an apparatus for processing chain link fabric. The apparatus includes a welding assembly configured to weld together wire-end portions of the chain link fabric. The welding assembly includes a guiding assembly having a finger and a cam, which are configured to restrict the movement of the wire-end portions while the welding assembly welds the wire-end portions together. The finger and the cam are configured to move relative to the wire-end portions both before and after the wire-end portions are welded together.

In other, more detailed features of the invention, the cam is configured to rotate toward the wire-end portion, as the finger moves toward the wire-end portions. Also, the cam is configured to rotate away from the wire-end portions, as the finger moves away from the wire-end portions. In addition, the guiding assembly can further include a guiding assembly air cylinder, a guiding assembly air cylinder shaft, which interfaces with the guiding assembly air cylinder, and a finger block, which is coupled between the guiding assembly air cylinder shaft and the finger. The guiding assembly air cylinder in combination with the guiding assembly air shaft is configured to move the finger block and the finger relative to the wire-end portion. In addition, the finger block can contact the cam as the finger moves toward the wire-end portions causing the cam to rotate toward the wire-end portions. Furthermore, the cam can rotate away from the wire-end portions as the finger moves away from the wire-end portions.

The welding assembly can further include a pair of electrodes, and the finger and the cam together restrict the movement of the wire-end portions while the pair of electrodes contact the wire-end portions and weld the wire-end portions together. Also, the finger and the cam are configured to move away from the wire-end portion after the wire-end portion is welded. In addition, the guiding assembly can further include a pad that is configured to support the chain link fabric while the wire-end portions are welded together. The position of the pad can be adjusted.

In recognition of the fact that the welded wire-end portions can have sharp edges, the apparatus can further comprise a compressing assembly configured to compress the wire-end portions after the wire-end portions are welded together and to remove the sharp edges of the welded wire-end portions. Also, the apparatus can further include a testing assembly configured to test the integrity of the wire-end portions after the wire-end portions are welded together. In addition, the apparatus can further include a painting assembly configured to apply a coating of a material on the wire-end portions after the wire-end portions are welded together. The apparatus can further include a cutting assembly configured to cut the chain link fabric resulting in the wire-end portions. Also, the apparatus can further include a bending assembly configured to bend the wire-end portions so that two of the wire-end portions are adjacent to one another before the adjacent wire-end portions are welded together.

The present invention also resides in an apparatus for processing chain link fabric that includes a compressing assembly that is configured to compress wire-end portions of the chain link fabric after the wire-end portions have been welded together. The compressing assembly includes a stabilizing assembly having a stabilizing die, which is configured to interface with the chain link fabric and to restrict the movement of the welded wire-end portions while the compressing assembly compresses the welded wire-end portions.

The welded wire-end portions can include sharp edges, and the compressing assembly is configured to remove the sharp edges from the welded wire-end portions. Also, the stabilizing die can be triangular in shape, and configured to interface with square-shaped openings in the chain link fabric. In addition, the stabilizing die can have a beveled edge.

The compressing assembly can further include a compressing assembly air cylinder and a compressing assembly air cylinder shaft, which interfaces with the compressing assembly air cylinder. The compressing assembly air cylinder is configured to apply a force to the compressing assembly air cylinder shaft, which results in the stabilizing die interfacing with the chain link fabric. The compressing assembly can further include a guide, which is coupled to the compressing assembly air cylinder shaft. The guide is configured to be moved by movement of the compressing assembly air cylinder shaft, and positioned adjacent to the wire-end portions in an opposed relationship with the stabilizing die.

The stabilizing assembly can further include a lever, which is coupled between the stabilizing die and the compressing assembly air cylinder shaft. The lever is pivotably coupled to the compressing assembly. The compressing assembly air cylinder is configured to apply a force on the compressing assembly air cylinder shaft that, in turn, moves the lever causing the stabilizing die to interface with the chain link fabric. The stabilizing assembly can further include a die plate, which is coupled between the stabilizing die and the lever. The die plate has a surface, and the stabilizing die is coupled to the surface of the die plate. The position of the stabilizing die on the surface of the die plate can be adjusted.

The compressing assembly can include an electrode holder, which is coupled to the compressing assembly air cylinder shaft. Also, the stabilizing assembly can further include an arm having a first end, which is coupled to the electrode holder, and a second end, which includes an arm bore. The rod can include a first end, which is inserted through the arm bore so that the rod is slidingly coupled to the arm, and a second end. In addition, the stabilizing assembly can include an eyelet mount, which has a first end that is coupled to the rod's second end, and a second end. The lever can include a first end pivotably coupled to the eyelet mount's second end, a second end, which is coupled to the die plate, and a bore located between the first end and the second end of the lever. Furthermore, the compressing assembly can include an interfacing piece having a first end, which is coupled to the compressing assembly, and a second end, which includes a bore. Also, the compressing assembly can include a bolt, which is positioned through the bore in the second end of the interfacing piece and the bore in the lever, and which pivotably couples the lever to the interfacing piece.

The present invention also resides in a method for processing chain link fabric. The method includes providing wire-end portions of the chain link fabric, welding together the wire-end portions of the chain link fabric, providing a guiding assembly, which includes a finger and a cam, restricting the movement of the wire-end portions using the finger and the cam while the wire-end portions are welded together, and moving the finger and the cam relative to the wire-end portions before and after the wire-end portions are welded together.

The method can further include moving the finger toward the wire-end portion before the wire-end portions are welded together, and rotating the cam toward the wire-end portion as the finger moves toward the wire-end portion. Also, the method can further include moving the finger away from the wire-end portion after the wire-end portions are welded together, and rotating the cam away from the wire-end portion as the finger moves away from the wire-end portion.

The present invention can also reside in another method for processing chain link fabric that includes providing wire-end portions of the chain link fabric, providing a compressing assembly, using the compressing assembly to compress wire-end portions of the chain link fabric after the wire-end portions have been welded together, providing a stabilizing assembly having a stabilizing die, and interfacing the stabilizing die with the chain link fabric so as to restrict the movement of the welded wire-end portions while the compressing assembly compresses the welded wire-end portions.

Also, the method can further include providing an air cylinder, and using the air cylinder to generate a force to interface the stabilizing die with the chain link fabric. The method can further include providing a guide, and positioning the guide adjacent to the welded wire-end portions while the compressing assembly compresses the welded wire-end portions.

Other features and advantages of the present invention will become apparent from the following description of the preferred embodiments, taken in conjunction with the accompanying drawings, which illustrate, by way of example, the principals of the invention, the invention not being limited to any particular preferred embodiment(s) disclosed.

BRIEF DESCRIPTION OF THE DRAWINGS

The invention will now be described with reference to the presently preferred embodiments shown in the following drawings, which are provided only as examples to illustrate the principles of the invention. The invention is not limited to the embodiments shown, and variations will be apparent to those skilled in the art. The embodiments are not shown or described in more detail than necessary to describe the invention, and the manner and process of making and using it, to those skilled in the art.

FIG. 5 is an enlarged, right, perspective view of the compressing assembly shown in FIG. 1.

FIG. 6 is an enlarged, elevational view of a compressed joint shown in FIG. 1.

DETAILED DESCRIPTION OF THE PREFERRED EMBODIMENTS

The present invention provides for an improved chain link fabric having flattened end portions and a method and apparatus for making the flattened end portions. The method and apparatus for making flattened end portions and the chain link fabric itself, described herein, provide a number of significant advantages. By way of example only, some of the advantages of the present invention include, extending the useful life of the fabric and reducing the need to replace or repair the fabric; providing an aesthetically pleasing, taut fabric with flattened end portions that are strong enough to resist a large force without becoming bent or crushed; preventing serious injury to installers and those who come into contact with the chain link fabric by providing a fabric without sharp or protruding edges; providing a fabric that does not tangle and can be quickly and safely prepared for shipping and installation; and reducing the expense and repair associated with traditional chain link fences by eliminating the need for tension wires, top rails, crimp wires, or their equivalents.

Figure 1:
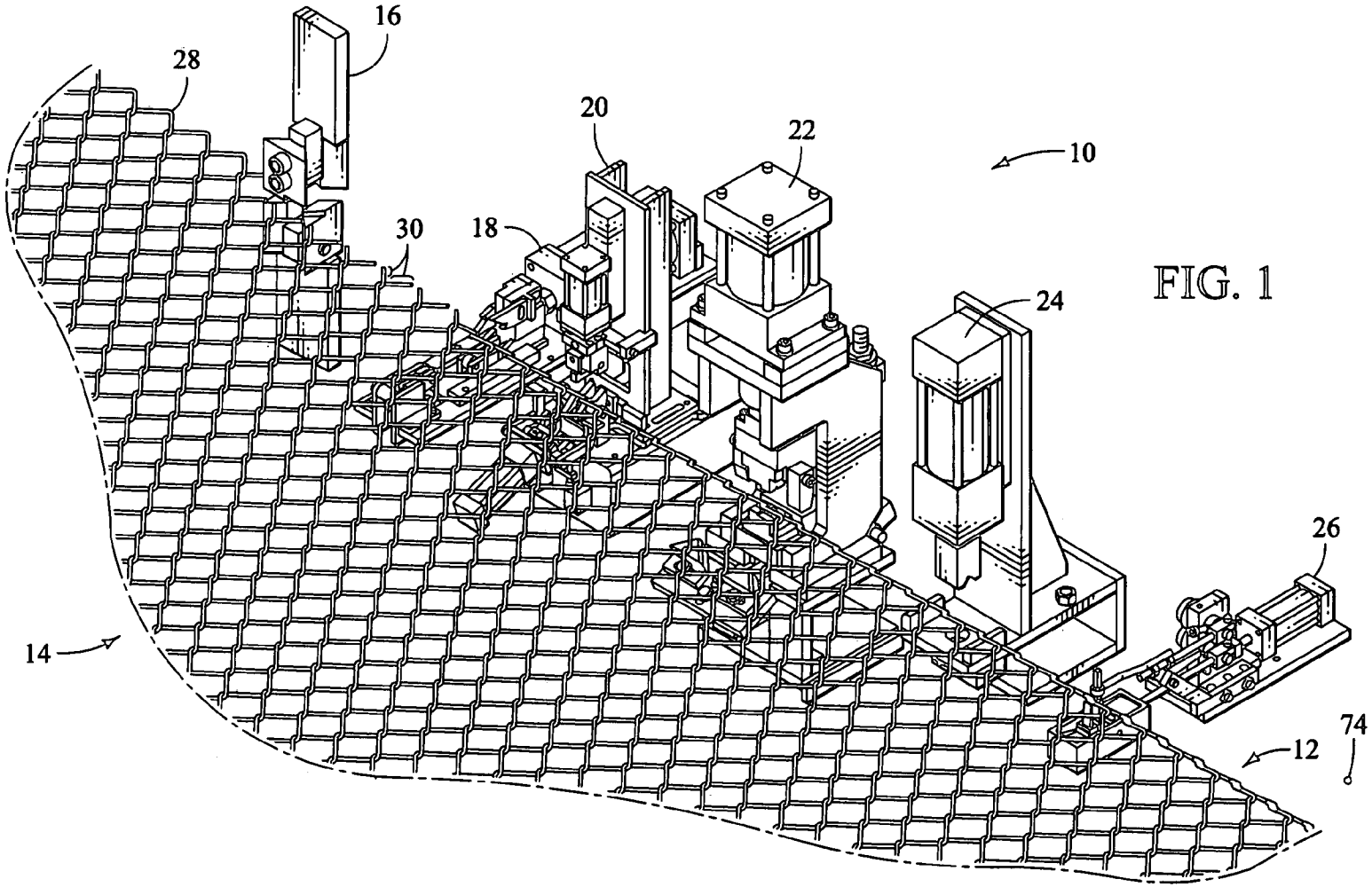
FIG. 1 is a right, perspective view of an improved chain link fabric with flattened end portions and an apparatus for forming the flattened end portions, in accordance with the present invention, showing the effect each of the assemblies of the apparatus has on forming the flattened end portions.

Referring now to the drawings, and particularly to FIG. 1, there is shown, by way of example and not limitation, an apparatus for forming the flattened end portions of the chain link fabric, which is indicated generally by reference numeral 10, in accordance with a preferred embodiment of the present invention. The structural components of a weaving apparatus for weaving the chain link fabric are well known in the art and are not shown or described herein. Accordingly, any weaving apparatus that produces chain link fabric may be used in conjunction with the present invention. The structural components of the apparatus for forming the flattened end portions 12 and the woven chain link fabric 14 include a cutting assembly 16, a bending assembly 18, a welding assembly 20, a compressing assembly 22, a testing assembly 24, and a painting assembly 26. The specific structural components of each assembly are shown in more detail in FIGS. 2-15 and are described in more detail below.

Figure 2:
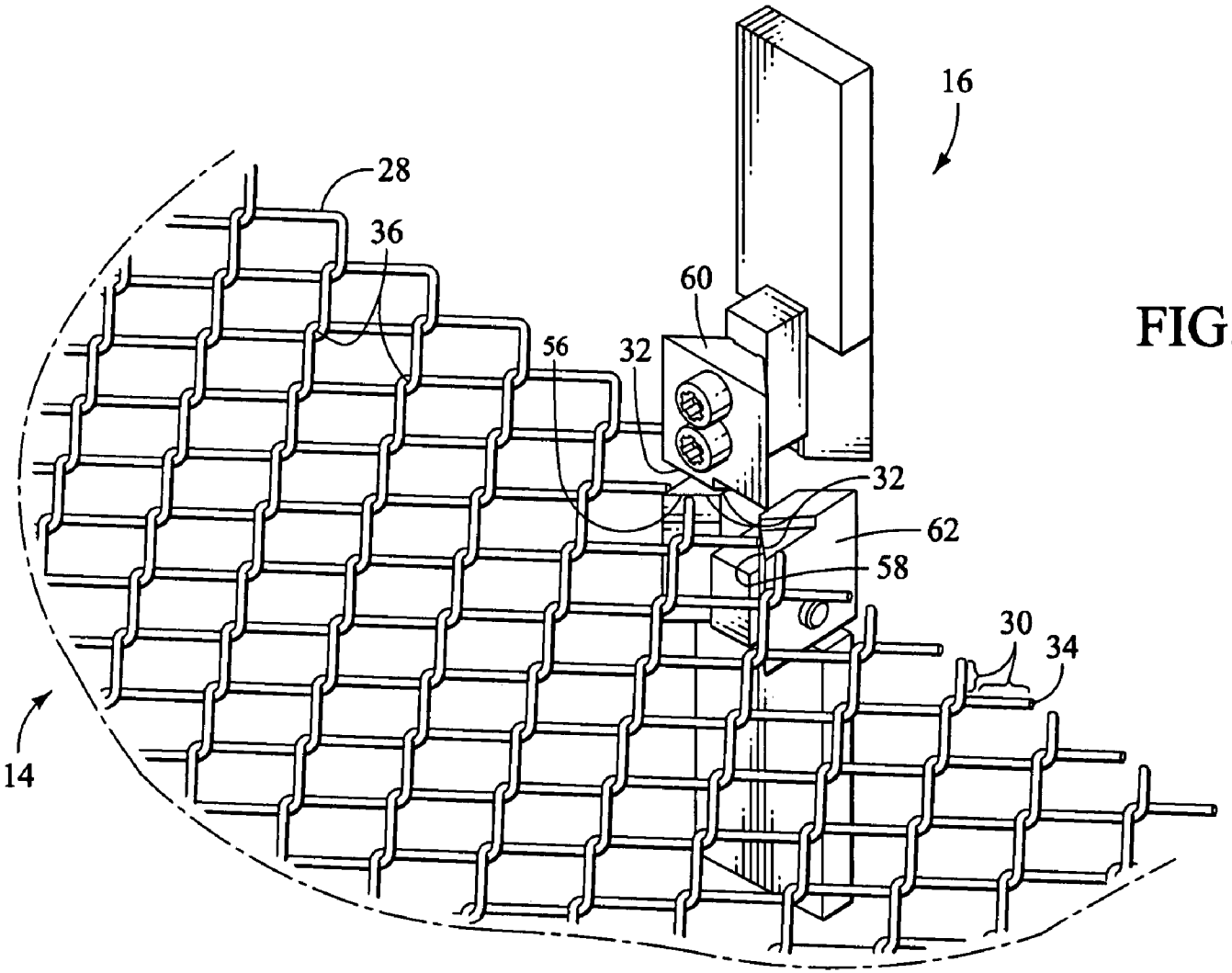
FIG. 2 is an enlarged, right, perspective view of the square cutter assembly used to cut the chain link fabric shown in FIG. 1.

FIG. 1 shows the woven chain link fabric 14 being indexed, i.e., incrementally stepped, through the apparatus 10 for forming flattened end portions 12. For purposes of clarity, and in order to show the formed ends 28 of the chain link fabric, the chain link fabric of FIGS. 1 and 2 is shown as having been completed upstream from the apparatus for forming flattened end portion, that is, before reaching the cutting assembly 16. In a preferred embodiment of the present invention, the chain link fabric is woven by a weaver that faces the cutting assembly and feeds the chain link fabric into the cutter assembly from the front as the chain link fabric is formed, rather than from the side as shown in FIG. 1. Alternatively, it is within the scope of the present invention to feed a pre-woven sheet of chain link fabric, similar to the one shown in FIG. 1, into the apparatus for forming the flattened end portions of the present invention.

Referring to FIG. 2, the cutting assembly 16 functions to cut the formed ends 28 of the chain link fabric 14 in one step to form two, square cut wire-end portions 30. The chain link fabric shown in FIG. 2, is positioned to be cut by the blades 32 of the cutting assembly at an angle that results in the wire-end portions having flat ends 34. Each wire-end portion extends from an elbow 36 of the chain link fabric. In accordance with the present invention, other types of cutting assemblies that cut at a different angle can be used. For example, and not by way of limitation, the cutting assembly could be modified to cut the chain link fabric at an angle such that after the adjacent, wire-end portions are bent toward each other, and the wire-end portions are aligned in an overlapping fashion, and the aligned and overlapped wire-end portions do not have any sharp or protruding edges.

Figure 3:
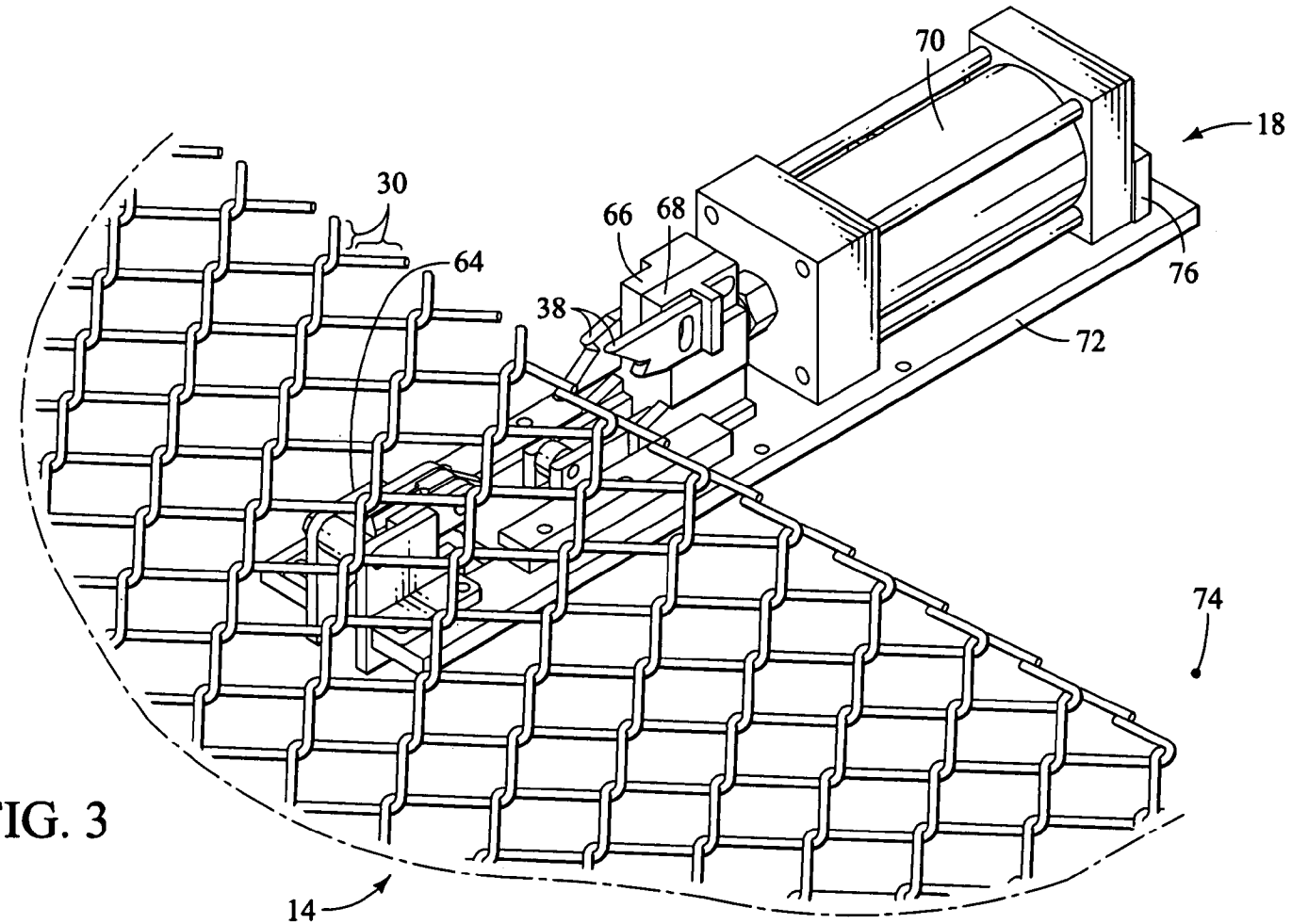
FIG. 3 is an enlarged, right, perspective view of the bender assembly shown in FIG. 1.

After the cutting assembly 16 cuts the chain link fabric 14, the extending wire-end portions 30 are indexed down to the bending assembly 18, which is shown in greater detail in FIG. 3. The bending assembly uses knuckling blades 38 to bend adjacent, wire-end portions 30 toward each other. Even though FIGS. 1 and 3 show the knuckling blades of bending assembly bending two adjacent, wire-end portions toward each other, the present invention includes other methods of bending the wire-end portions of the chain link fabric. For example, and not by limitation, the present invention includes using a bending assembly that bends non-adjacent, wire-end portions away from one another until the non-adjacent, wire-end portions are in close proximity to each other. FIG. 1 shows the formed ends 28 being cut by the cutting assembly and bent by the bending assembly so that at least a portion of wire portions overlap each other, as also shown in FIG. 3.

After the bending assembly 18 bends the wire-end portions 30, the bent, wire-end portions are indexed to the welding assembly 20. The welding assembly fastens the two, adjacent, wire-end portions 40 together. In the preferred embodiment shown in FIGS. 1 and 4, the welding assembly provides a lap weld 42 of the overlapping portions of the two, adjacent, wire-end portions. In accordance with the present invention, the welding assembly also can secure the two, adjacent, wire-end portions using any means known in the art, including, but not limited to, using a clip, a sleeve, an adhesive, a wire, a metal strip, or a binding agent. After the welding assembly secures the two wire-end portions together, the secured wire-end portions provide tension to support the chain link fabric 14. Typically, the aligned flat ends 34 of the wire-end portions form sharp or protruding edges 44.

Referring additionally to FIG. 5, to eliminate or reduce the potential danger created by the protruding edges 44 at the adjoined wire-end portions 40, the adjoined wire-end portions are indexed to a compressing assembly 22. The compressing assembly places pressure on portions of the adjoined wire-end portions, causing the sharp or protruding edges at the ends of the wire-end portions to be eliminated or greatly reduced, as shown in FIG. 6. By eliminating, or greatly reducing, the protruding edges formed by the adjoined wire-end portions, the adjoined wire-end portions are made safer because they are less likely to cause injury to individuals who come into contact with them.

An additional advantage of the present invention is that the pressure exerted by the compressing assembly 22 on the adjoined wire-end portions 40 increases the tensile strength of the wire-end portions, making the bond between the wire-end portions stronger. The compressing assembly helps prevent splintering, a known problem with chain link fabrics 14 including wires 46 that are butt welded together, because the tensile strength of the wires is increased by the compressing process implemented by the compressing assembly. Accordingly, not only do the stronger connections between the wire-end portions result in a more durable and longer lasting chain link fabric, but they result in wire-end portions that are safer because they are less likely to splinter.

After the adjoined wire-end portions 40 of the chain link fabric 14 have been compressed, the compressed and adjoined wire-end portion 48 is indexed to the testing assembly 24, which tests the strength of the connection formed by the welding assembly 20 and the compressing assembly 22. In the preferred embodiment shown in FIG. 7, a block 50 having a centered triangular cutout 52 along the entire length of its bottom face is forced down onto the adjoined wire-end portions, exerting a large force on them. If the block travels downward past a predetermined point, an alarm sounds and the weaving and selvage process is temporarily stopped. The alarm signals that the two adjoining wire-end portions 40 were not properly secured together. By sounding an alarm and temporarily stopping the weaving and selvage process, the testing assembly allows the improperly formed joint to be repaired before the weaving and selvage process continues. Additionally, the testing assembly reduces the chances that a flattened end portion 12 having a poor connection will leave the factory and cause harm to someone, or will need to be repaired.

Figure 8:
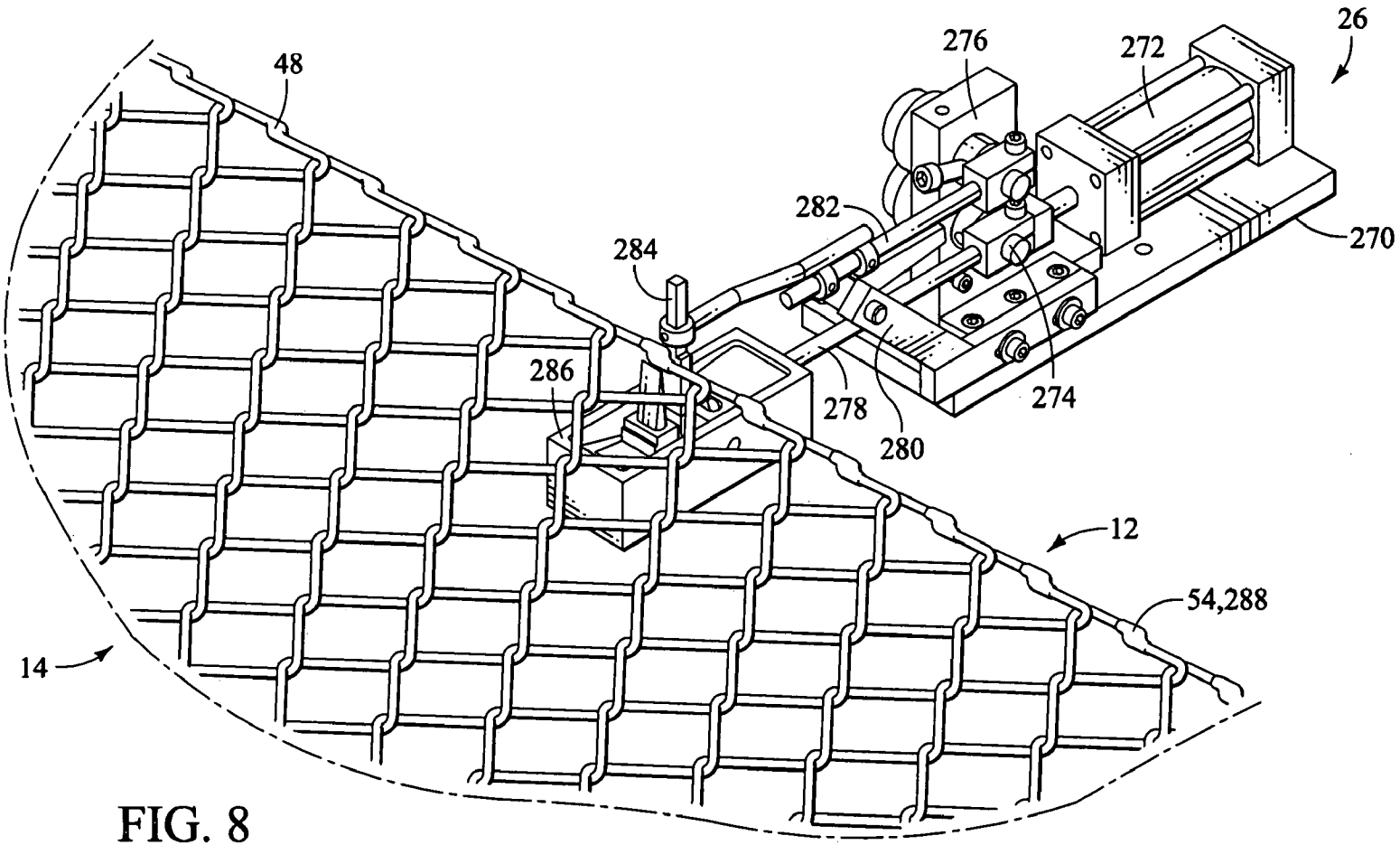
FIG. 8 is an enlarged, right, perspective view of the painting assembly shown in FIG. 1.

Referring additionally to FIG. 8, the last assembly included in the apparatus 10 is the painting assembly 26, which can add a layer 54, or a coating, of any substance to the wire-end portions 48. In a preferred embodiment of the present invention, the substance applied to the wire-end portions is zinc. In accordance with the present invention, any substance known in the art to add strength or durability, or improve the aesthetic appearance, of the wire-end portions can be applied to the wire-end portions using the painting assembly.

The finished chain link fabric 14 may then be moved incrementally over guided rollers and taken up by a take up unit. Typically the finished chain link fabric is tightly rolled into large rolls that are ready for shipping and installation. Once the chain link fabric arrives at its intended destination, the flattened end portions 12 allow the chain link fabric to be rolled out like a carpet without the wire-end portions 30 getting caught and tangled.

In accordance with the present invention, the assemblies 16-26 shown in FIGS. 1-8 can be moved around and rearranged in various different orders. Therefore, the scope of the present invention includes performing the different tasks of the assemblies in a different order. Additionally, it is within the scope of the present invention to remove one or more of the assemblies shown in FIGS. 1-8 from the apparatus 10 of the present invention.

Referring now to FIG. 2, there is shown, by way of example only, an enlarged view of the cutting assembly 16 shown in FIG. 1. FIG. 2 shows the cutting assembly having cutting edges 56 and 58, which cut the formed ends 28 of woven chain link fabric 14 to have sharp and flat cut ends 34 in one step. The formed ends are cut by having the top portion 60 of the cutting assembly come together with the bottom portion 62 of the cutting assembly. The top and bottom portions can be brought together to cut the formed ends of the chain link fabric, and then separated, by an air cylinder (not shown) or another mechanical interface. The air cylinder or another mechanical interface can be activated by a triggering device, e.g., a computer, which is coupled to the cutting assembly, and can be located remote from the cutting assembly. Additionally, as indicated above, the scope of the present invention includes using any known cutting apparatus to cut the formed ends at any angle.

FIG. 3 shows, by way of example only, an enlarged view of the bending assembly 18 shown in FIG. 1. The bending assembly has a support assembly 64, which supports and guides the chain link fabric 14 into position for the knuckling blades 38 to bend them to the appropriate position. The knuckling blades are attached to a knuckling bracket 66 and adjustable support 68, which can be adjusted to modify the position of the knuckling blades.

The knuckling blades 38 are coupled to an air cylinder 70, which uses compressed air to move the knuckling blades toward and away from the wire-end portions 30. The air cylinder is mounted on a mounting plate 72, which rests on a supporting surface 74, and is supported by a cylinder adjusting block 76, which allows the air cylinder and the attached knuckling blades to be moved toward and away from the chain link fabric 14. The bending assembly's air cylinder can be activated by a triggering device, e.g., a PLC, to which the bending assembly's air cylinder is coupled. The triggering device can be located remote from the bending assembly.

Figure 4:
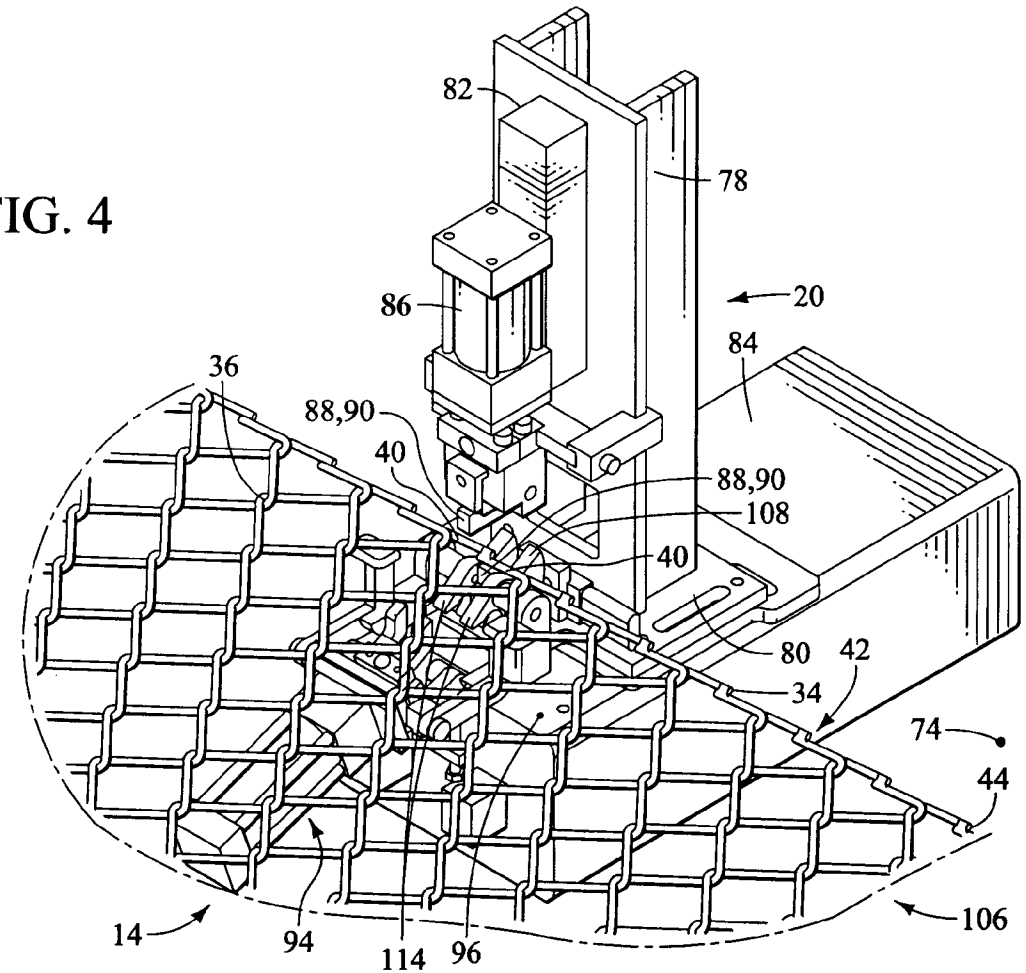
FIG. 4 is an enlarged, right, perspective view of the welding assembly shown in FIG. 1.

Referring now to FIGS. 4 and 9-11, there are shown, by way of example only, enlarged views of the welding assembly 20 shown in FIG. 1. FIG. 4 shows the welding assembly 20 with a welding bracket 78 attached to an upper base plate 80 and a cylinder mounting block 82 attached to the welding bracket. The upper base plate is attached to a transformer 84, which rests on the supporting surface 74. A first air cylinder 86 is attached to the cylinder mounting block. The welding assembly's first air cylinder can be activated by a triggering device, e.g., a PLC, to which the welding assembly's first air cylinder is coupled. The triggering device can be located remotely from the compressing assembly.

The welding assembly 20 also includes a pair of welding electrodes 88, an upper electrode 90, which is coupled to the first air cylinder 86, and a lower electrode 92, which is vertically aligned beneath the upper electrode. During the welding process, the overlapping wire-end portions 40 are positioned between the upper and lower electrodes, which provide electrical current to the wire-end portions during the welding process.

The welding assembly 20 includes a guiding assembly 94, which holds the wire-end portions 40 in place during the welding process. The guiding assembly is coupled to the top surface 96 of the transformer 84, adjacent to the lower electrode 92. The guiding assembly includes a pair of fingers 98, which are connected to a finger block 100, which, in turn, is connected to an air cylinder shaft 102 that is part of a second air cylinder 104, also referred to as the guiding assembly air cylinder. The pair of fingers are made from, or coated with, any material that does not conduct electricity, e.g., a non-conducting ceramic. The welding assembly's second air cylinder can be activated by a triggering device, e.g., a PLC, to which the second air cylinder is coupled. The triggering device can be located remotely from the compressing assembly.

Figure 9:
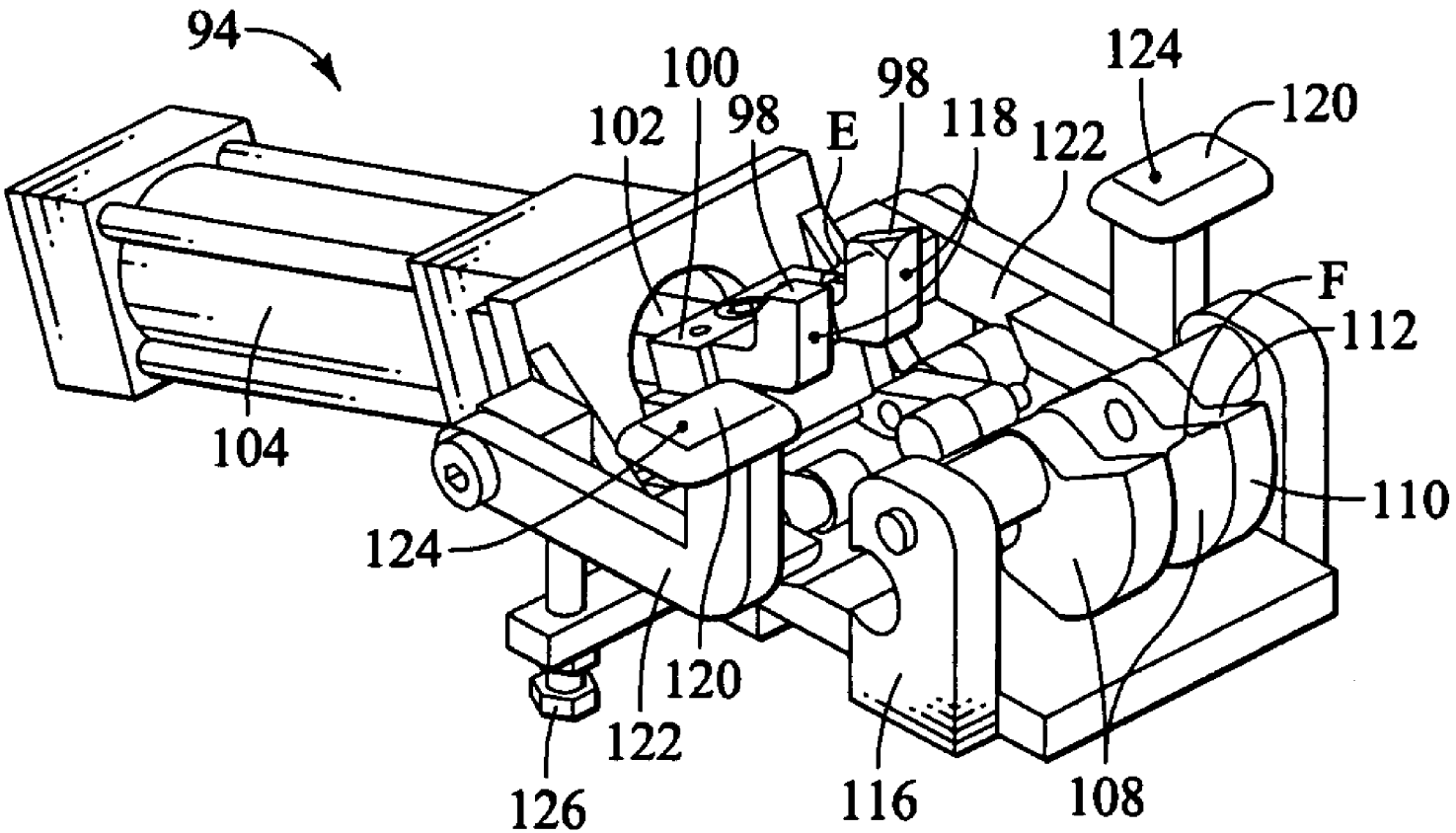
FIG. 9 is an enlarged, left, perspective view of a guiding assembly, which is included as part of the welding assembly shown in FIG. 4.

As shown in FIGS. 4 and 9, when the guiding assembly 94 is in its fully open position, the second air cylinder's shaft 102 is retracted into the second air cylinder 104, and the fingers 98 and the finger block 100 are located adjacent to the second air cylinder beneath the plane 106 of the chain link fabric 14. Thus, when the guiding assembly is in its fully open position, the fingers are positioned away from the chain link fabric.

The guiding assembly 94 also includes two cams 108, with one cam located on either side of the lower electrode 92. Each of the cams include a rounded end 110, which includes a flat surface 112 that is configured to contact the wire-end portions 40, and an extension 114 that is configured to contact the finger block 100. Similar to the fingers 98, the cams are made from, or coated with, a material that does not conduct electricity. The cams are rotatably coupled to a supporting bracket 116. When the guiding assembly is in its fully open position, the flat surface of each cam is rotated away from the chain link fabric 14, as shown in FIG. 4.

Figure 10:
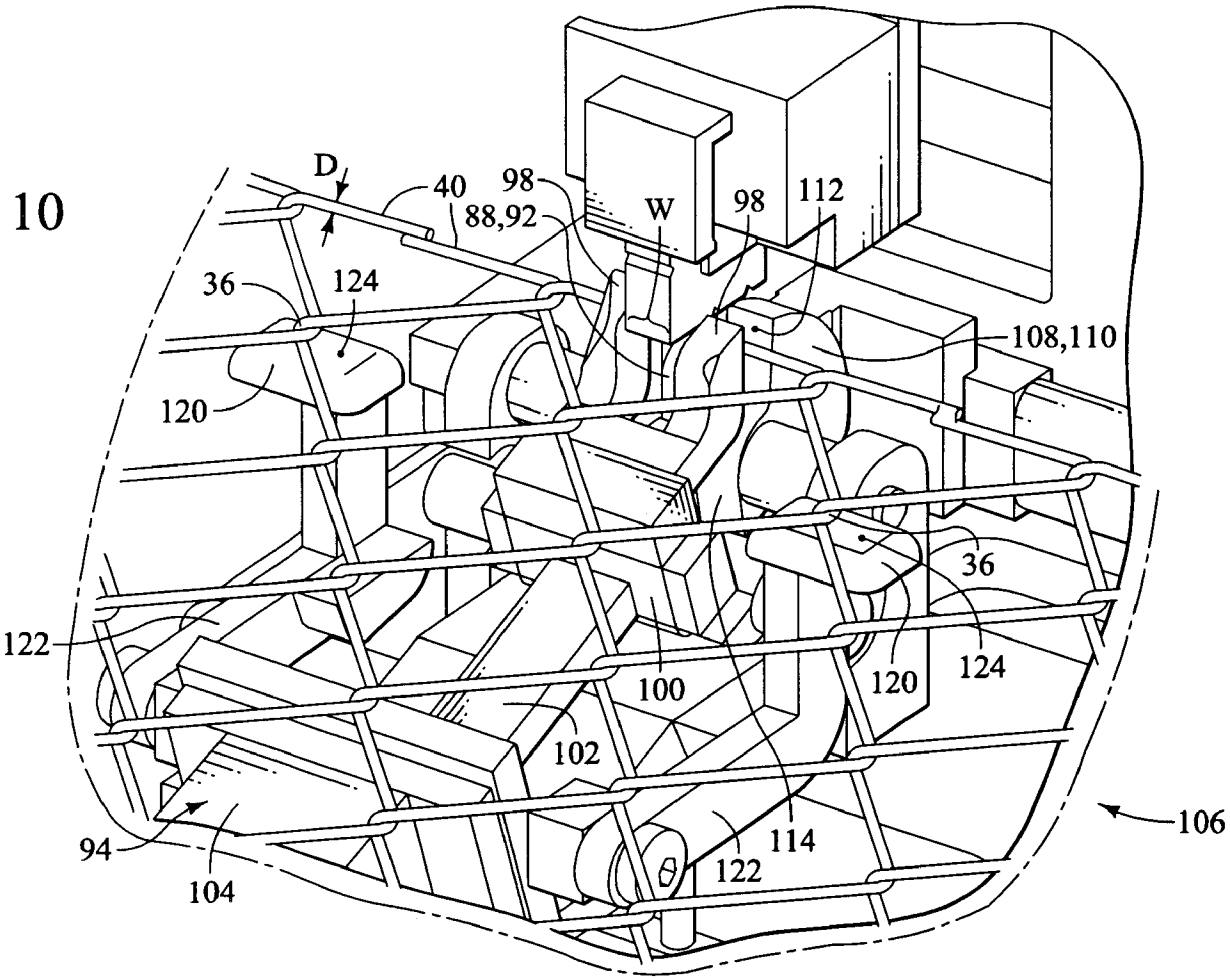
FIG. 10 is an enlarged, partial, right, perspective view of the stabilizer assembly of FIGS. 4 and 9 interfaced with the chain link fabric.

During the welding process, overlapping wire-end portions 40 are positioned above the lower electrode 92 and beneath the upper electrode 90. Next, the second air cylinder 104 pushes the fingers 98 upward toward the overlapping wire-end portions. As the fingers move toward the wire-end portions, the finger block 100 comes in contact with both cams' extensions 114, which causes the cams 108 to rotate from their initial positions, as shown in FIGS. 4 and 9, around toward a guiding position where the flat surface 112 of each cam is adjacent to the wire-end portions 40, as shown in FIGS. 10 and 11.

In the guiding position, each cam's flat surface 112 is in a spaced apart, and approximately parallel relationship, with a front surface 118 of one of the fingers 98. In this position, the cams' flat surfaces and the fingers' front surfaces are separated by a distance X, which is slightly greater than the diameter D of the wire-end portions 40. Thus, as shown in FIG. 11, the combination of the cams' flat surfaces and the fingers' front surfaces loosely hold the overlapping wire-end portions in position between the upper and lower electrodes 90 and 92, respectively, and the wire-end portions are allowed to slide up and down vertically between the cams' flat surfaces and the fingers' front surfaces.

Next, the first air cylinder 86 moves the upper electrode 90 downward toward the overlapping wire-end portions 40, eventually contacting the overlapping wire-end portions, and pushing the overlapping wire-end portions downward until the overlapping wire-end portions also contact the lower electrode 92. At which point, an electrical current flows between the upper and lower electrodes and through the overlapping wire-end portions. Because the fingers 98 and the cams 108 are made from, or coated with, a non-conducting material, electrical current is not shunted away from the overlapping wire-end portions through the fingers and cams during the welding process. The electrical current flowing through the overlapping wire-end portions ultimately welds the overlapping wire-end portions together.

Figure 11:
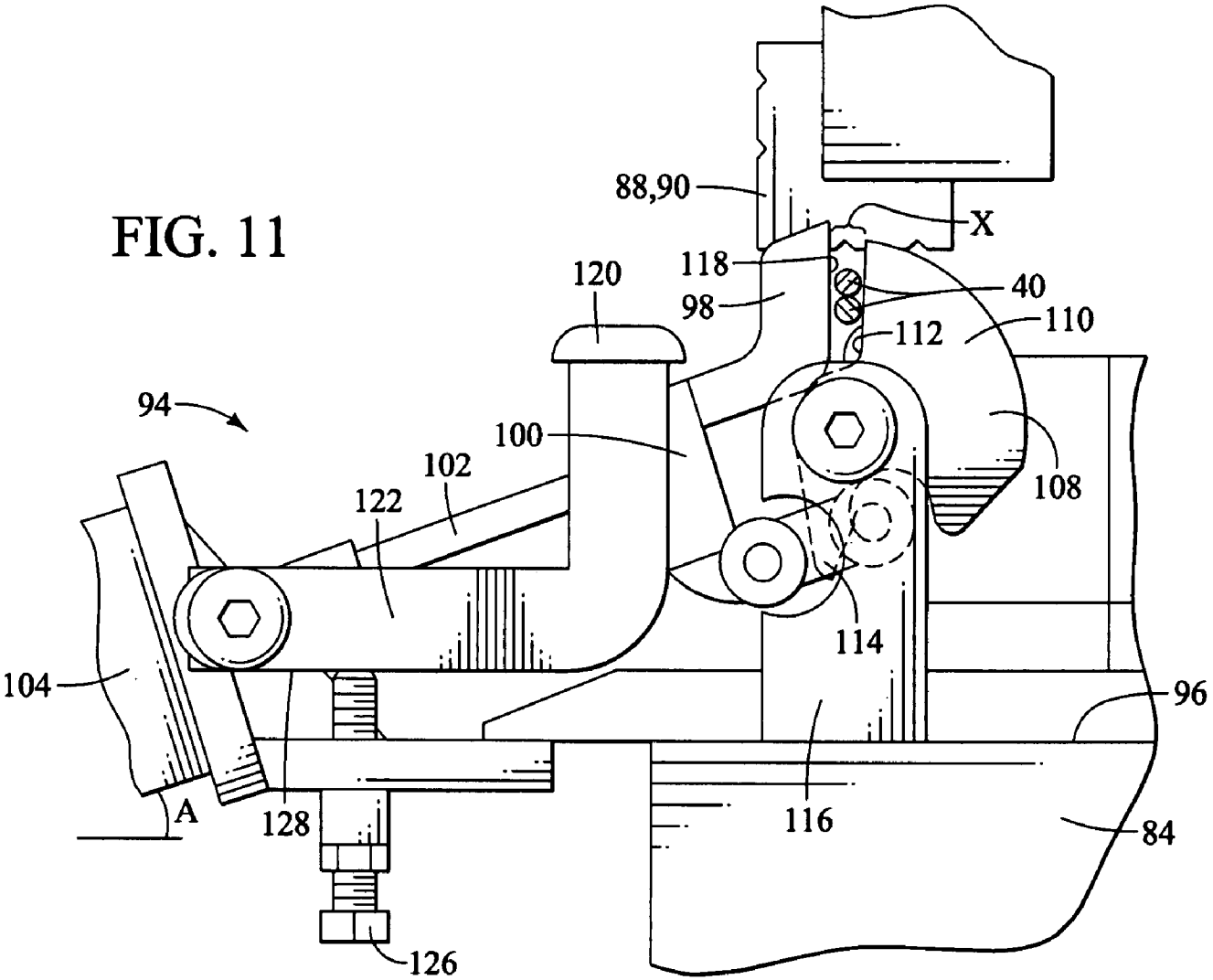
FIG. 11 is an enlarged, partial, right, elevational view of the stabilizer assembly interfaced with the chain link fabric shown in FIG. 10.

Advantageously, the fingers 98 and cams 108 of the guiding assembly 94 hold the overlapping wire-end portions 40, one over the other, as shown in FIG. 11, or "lapped," in a stable position before and during the welding process. The combination of the fingers and the cams does not apply pressure to the overlapping wire-end portions, rather, the combination of the fingers and the cams merely maintains the position of the two overlapping wire-end portions, and restricts the movement of the wire-end portions, while the two wire-end portions are welded together. Accordingly, the guide assembly, in particular, the combination of the fingers and the cams, advantageously minimizes movement or shifting of the wire-end portions during the welding process, thus, resulting in more consistent positioning of the overlapping wire-end portions relative to one another during the welding process.

As shown in FIGS. 4, 9, and 10, both the fingers 98 and the cams 108 are separated by distances E and F, respectively, that are wider than the widths W of the upper and lower electrodes 90 and 92, respectively. Accordingly, as the upper electrode moves in and out of contact with the overlapping wire-end portions 40, the fingers and the cams allow for the upper electrode to pass between the two fingers and between the two cams. Also, the distance F between the cams accommodates the lower electrode.

The guide assembly 94 also includes two rounded pads 120, each of which is supported by an angle 122. As shown in FIG. 10, the rounded pads in combination with the angles function to vertically support the chain link fabric 14, as the upper electrode 90 presses down on the overlapping wire-end portions 40 during the welding process. As the upper electrode presses down on the overlapping wire-end portions, the chain link fabric, at or near the elbows 36, rests on a top surface 124 of each rounded pad. Thus, the rounded pads in combination with the angles prevent excessive vertical movement of the chain link fabric during the welding process. Referring additionally to FIG. 11, the height of each rounded pad above the top surface 96 of the transformer 84 is adjustable by adjusting the position of an offset screw 126, which pushes against a bottom surface 128 of the angle beneath the rounded pad.

After the overlapping wire-end portions 40 are welded together, the first cylinder 86 pulls the upper electrode 90 upward and away from the welded wire-end portions. At, or about, the same time, the second air cylinder 104 pulls the fingers 98 and the finger block 100 away from the welded wire-end portions and back toward the second air cylinder. As the fingers and the finger block move away from the welded wire-end portions, the cams 108 rotate away from the wire-end portions. Eventually, the upper electrode and the fingers wind up in their fully retracted positions, as shown in FIG. 4, and the chain link fabric 14 is free to index so that the next overlapping wire-end portions to be welded are positioned between the upper and lower electrodes 90 and 92, respectively, in preparation for welding.

As shown in FIG. 11, the second air cylinder 104 is mounted at such an angle A relative to the top surface 96 of the transformer 84 so that during use, the fingers 98 move toward, and away from, the overlapping wire-end portions 40 from beneath the plane 106 of the chain link fabric 14. Accordingly, the fingers lie well below the plane of the chain link fabric as the chain link fabric is indexed. Thus, preventing the chain link fabric from contacting and snagging on the fingers as the chain link fabric is indexed. Furthermore, when the guiding assembly 94 is in its fully retracted position, as shown in FIGS. 4 and 5, the flat surfaces 112 of the cams 108 are rotated away from the wire-end portions, thus, minimizing the likelihood of the chain link fabric contacting the cams as the chain link fabric is indexed.

In accordance with the present invention, the welding assembly 20 shown in FIG. 4 can be replaced with any apparatus that secures the overlapping wire-end portions 40 together, including, but not limited to a securing apparatus that uses sleeves, clips, adhesives, binding agents, or metal straps or their equivalent to couple the overlapping wire-end portions together.

Referring now to FIGS. 5 and 12-14, there is shown, by way of example only, enlarged views of the compressing assembly 22 shown in FIG. 1. In particular, the compressing assembly includes a compressing assembly air cylinder 130 that is mounted on top of a frame 132, which, in turn is mounted to the top surface 134 of a base plate 136. The bottom surface 138 of the base plate is connected to a supporting bracket 140, which rests on the supporting surface 74. The compressing assembly's air cylinder can be activated by a triggering device, e.g., a computer, to which the compressing assembly's air cylinder is coupled. The triggering device can be located remotely from the compressing assembly.

The air cylinder 130 interfaces with one end (not shown) of a compressing assembly air cylinder shaft 142, and the other end (not shown) of the shaft is threaded and interfaces with a bore (not shown) in an upper block 144. A nut 146 interfaces with the threaded end of the shaft and secures the position of the upper block relative to the threaded end of the shaft. Thus, when the air cylinder is activated, the air cylinder is configured to move the shaft, and thus, the upper block from one point to another.

The bottom surface 148 of the upper block 144 is connected to a top surface 150 of an upper die holder 152 by means of four screws 154, each of which is inserted through one of four bores (not shown) in the upper block. The upper die holder also interfaces with an upper die 156, which includes a bottom surface 158 having a recessed channel 160, which is configured to interface with welded wire-end portions 40.

Two guides 162 are connected to the upper die holder 152, one on each side surface 162 (only one shown) of the upper die holder. Both of the guides extend down from the upper die holder toward the base plate 136. At one end 164 of each guide is a bore (not shown) through which a screw 166 is inserted to secure the one end 164 of the guide to the upper die holder. Because the guide is coupled to the upper die holder only at one end, the guide can be pivoted about the screw relative to the upper die holder. Thus, the position of each guide relative to the upper die holder can be adjusted.

The compressing assembly 22 also includes a lower block 168 having a bottom surface (not shown), which is coupled to the top surface 134 of the base plate 136. A lower die 170 is coupled to the top surface 172 of the lower block, with the lower die vertically aligned with the upper die 156. The lower die, similar to the upper die, includes a recessed channel 174, which is configured to interface with welded wire-end portions 40. The upper and lower dies are traditional dies made of a durable material, and the recessed channels 160 and 174 in each of the upper and lower dies, respectively, is formed into a shape that will apply pressure to specific areas of the wire-end portions that are to be compressed.

Figure 15:
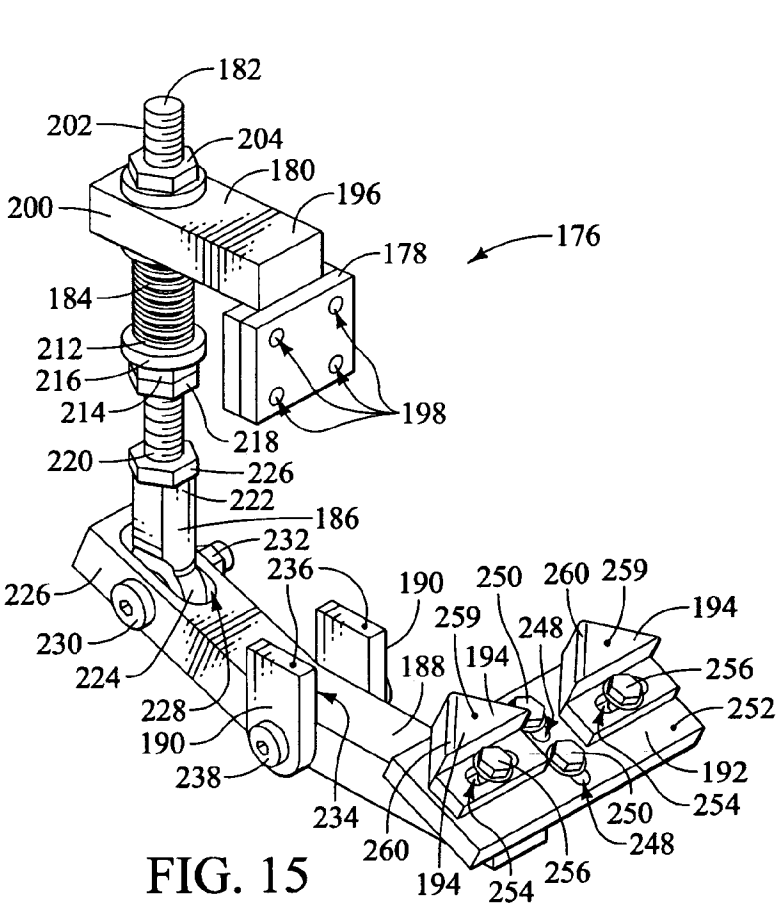
FIG. 15 is an enlarged, left, perspective view of the stabilizing assembly shown in FIGS. 5, and 12-14.

Referring to FIG. 15, the compressing assembly 22 also includes a stabilizing assembly 176 having an interfacing plate 178, an arm 180, a threaded rod 182, a spring 184, an eyelet mount 186, a lever 188, two supporting pieces 190, a die plate 192, and two triangular stabilizing dies 194. The interfacing plate is connected to a first end 196 of the arm, and the interfacing plate includes four bores 198 through which screws (not shown) are inserted to couple the interfacing plate to a back surface (not shown) of the upper die holder 152. A second end 200 of the arm includes a bore (not shown), through which a first end 202 of the rod inserts. A first nut 204 interfaces with the first end of the threaded rod.

Figure 13:
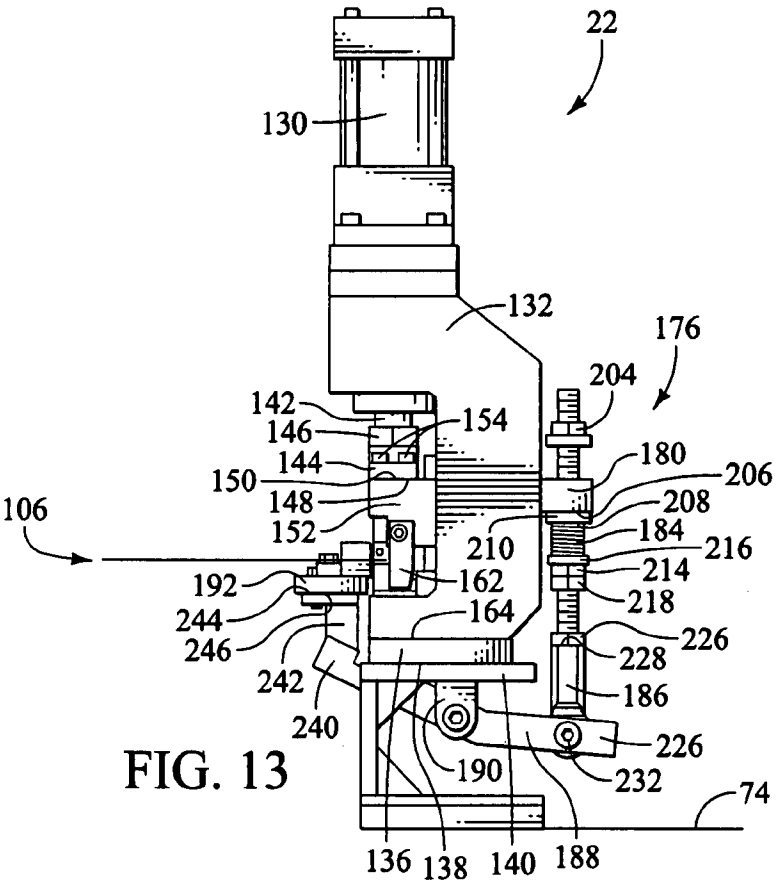
FIG. 13 is a right, elevational view of the compressing assembly shown in FIG. 5 with a stabilizing assembly interfaced with the chain link fabric.

Referring additionally to FIG. 13, the spring 184 is coaxially positioned about the rod 182 beneath the bottom surface 206 of the arm 180. In particular, a first end 208 of the spring 184 is positioned adjacent to the arm's bottom surface, with a first washer 210 located between the spring's first end and the arm's bottom surface. A second end 212 of the spring is fixed relative to the rod by the position of a second nut 214, which interfaces with the rod. A second washer 216 is located between the second end of the spring and the second nut. A third nut 218 also interfaces with the rod, and is located adjacent to, and below, the second nut. The third nut is configured to secure the position of the second nut, and therefore, the second washer, relative to the rod.

The second and third nuts 214 and 218, respectively, can be moved along the length of the threaded rod 182. Depending upon where the second and third nuts are positioned along the rod, the spring 184 will be compressed, or allowed to expand, from its initial configuration, as shown in FIG. 15, before the position of the second and third nut along the rod was changed. Therefore, by adjusting the position of the second and third nut on the rod, the amount of force applied by the spring against the first and second washers 210 and 216, respectively, can be adjusted.

A second end 220 of the threaded rod 182 is interfaced with a first end 222 of the eyelet mount 186, a second end 224 of which includes the eyelet aperture (not shown). The second end of the rod is secured in place relative to the first end of the eyelet mount with a nut 226 that is tightened against a top surface 228 of the eyelet mount.

The lever 188 is an angled bar that includes a first end 226 having a slot 228 configured to accept and interface with the second end 224 of the eyelet mount 186. The lever's first end also includes two aligned holes (not shown), through which a first bolt 230 is inserted along with the eyelet's aperture (not shown). The first bolt is secured in place with a first nut 232. Accordingly, the lever's first end can pivot about the first bolt relative to the eyelet aperture.

The lever 188 also includes a bore (not shown) that passes laterally through the lever near where the lever bends 234. The stabilizing assembly includes two supporting pieces 190, each having a top surface 236, which connects to the bottom surface (not shown) of the compressing assembly's base plate 136. Each of the supporting pieces includes an interfacing bore (not shown), which is aligned with the lever's bore, and through which a bolt 238 is inserted. Accordingly, the lever is rotatably coupled to, and supported by, the two supporting pieces, and thus, the lever is rotatably coupled to, and supported by, the base plate of the compressing assembly 22.

Figure 12:
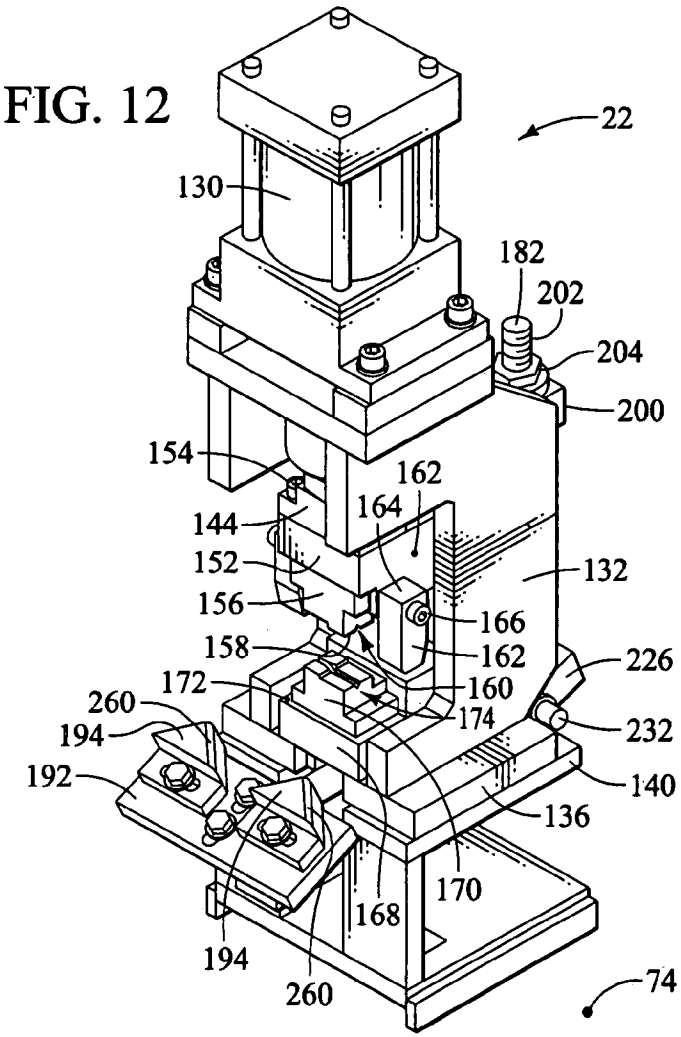
FIG. 12 is an enlarged, right, perspective view of the compressing assembly of FIG. 5 with the stabilizing assembly in an open position.

The other end 240 of the lever 188 includes an extension 242 having a top surface 244 with two holes (not shown), the top surface of the extension connects to the bottom surface 246 of the die plate 192. The die plate includes a pair of slots 248 through which a pair of screws 250 respectively are inserted into the holes in the extension's top surface to secure the bottom surface of the die plate to the top surface of the extension. Because the die plate is coupled to the extension using a slot interface, the position of the die plate can be adjusted relative to the extension by loosening the two screws, adjusting the position of the die plate relative to the extension, and then, tightening the two screws. In the fully retracted position, as shown in FIG. 12, the top surface of the die plate is angled downward and away from the chain link fabric The stabilizing dies 194 are coupled to a top surface 252 of the die plate 192, which includes two holes (not shown). In particular, each of the stabilizing dies includes a slot 254 through which a screw 256 is inserted into one of the holes in the top surface of the die plate. Because each of the stabilizing dies is coupled to the die plate using a slot interface, the position of each stabilizing die on the top surface of the die plate can be adjusted by loosening the screw, adjusting the position of the stabilizing die on the top surface of the die plate, and then, tightening the screw.

Initially, during use, the stabilizing assembly 176 is in its fully retracted position, as shown in FIGS. 5 and 12. As the compressing assembly 22 begins its compression process, the compressing assembly's air cylinder 130 provides a force that moves both the upper die 152 and the stabilizing assembly. In particular, the compressing assembly's air cylinder is configured to push the upper die holder downward toward the base plate 136, so that the upper die 156 moves toward the lower die 170. As the upper die holder moves downward, the arm 180 and the rod 182 also move downward causing the lever 188 to pivot about the bolt 238. As the lever pivots about the bolt, the die plate 192 moves upward toward the chain link fabric 14.

Figure 14:
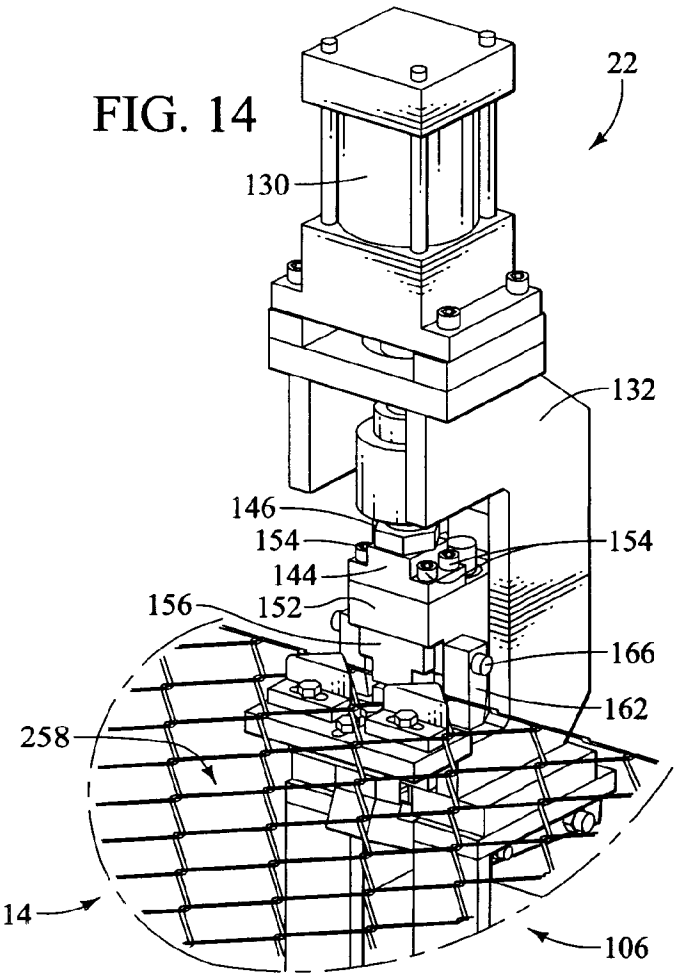
FIG. 14 is an enlarged, right, partial, perspective view of the compressing assembly of FIG. 5 with the stabilizing assembly interfaced with the chain link fabric.

Referring also to FIGS. 13 and 14, eventually, as the lever 188 pushes the die plate 192 upward, the stabilizing dies 194, which are triangular in shape, push upward through square-shaped openings 258 in the chain link fabric 14. The top surfaces 259 of the stabilizing dies include beveled edges 260, which facilitate the insertion of each stabilizing die through one of the square-shaped openings. The rotation of the lever about the bolt 238 will stop as a result of the lever contacting the base plate 136. At which point, as shown in FIGS. 13 and 14, the stabilizing dies are in their fully interfaced position relative to the chain link fabric, and the stabilizing dies in combination with the rest of the stabilizing assembly 176 acts to hold the chain link fabric steady during the compressing process. In this position, the die plate is in its fully lifted position and approximately parallel to the compressing assembly's base plate.

As discussed previously, the position of each stabilizing die 194 on the top surface 252 of the die plate 192 can be adjusted. The ability to adjust the position of the stabilizing dies relative to the die plate is advantageous because it also allows for the alignment of each stabilizing die with one of the square-shaped openings 258 in the chain link fabric 14.

The upper die holder 152 will continue to move downward, even after the lever 188 stops rotating about the bolt 238, and in doing so cause the arm 180 to move downward reducing the spacing between the first and second washers 210 and 216, respectively. As the space between the first and second washers is reduced, the spring 184 is compressed. The spring will continue to be compressed by the movement of the arm until the upper die holder has stopped its vertical movement downward toward the base plate 136.

As shown in FIGS. 13 and 14, the guides 162 move downward toward the base plate 136 as the upper die holder 152 travels downward. When the upper die 156 compresses against the welded wire-end portions 40 and the lower die 170, the guides are located behind the wire-end portions opposite the stabilizing dies 194. Advantageously, the combination of the guides and the stabilizing dies act to hold the welded wire-end portions in position for compressing.

Eventually, the continued movement of the upper die holder 152 downward toward the base plate 136 results in the upper die 156 contacting the welded wire-end portions 40. The upper die is forced downward even further toward the lower die 170 by the air cylinder 130 so that pressure is applied by the upper and lower dies on specific portions of the welded wire-end portions 26. Referring additionally to FIG. 5, in the preferred embodiments, the upper die and the lower die each are shaped so that they place pressure on the sharp or protruding ends 44 of the wire-end portions. The pressure from the upper and lower dies and removes or reduces the sharp edges at the ends of the wire-end portions and increases the tensile strength of the two wire-end portions, separately and together, causing them to have a stronger connection. FIG. 6 shows how the welded wire-end portions having sharp edges that could cause serious injury are compressed by the compressing assembly 22 to form a compressed joint 48, which has smooth and rounded edges.

Referring again to FIGS. 5 and 12-15, after the welded wire-end portions 40 have been compressed by the upper and lower dies 156 and 170, respectively, the compressing assembly's air cylinder 130 pulls the upper die away from the welded wire-end portions, and in doing so, lifts the upper die holder 152 and the arm 180. As the arm moves upward, the spring 184 expands until the movement of the arm relative to the rod 182 is restricted by the first nut 204. After this point is reached, the arm lifts the rod upward causing the lever 188 to pivot about the bolt 238 and causing the die plate 192 and the stabilizing dies 194 to move downward and away from the chain link fabric 14. Advantageously, the stabilizing dies of the stabilizing assembly 176 retract below the plane 106 of the chain link fabric so that the chain link fabric can be indexed without snagging on the stabilizing dies or any other portion of the stabilizing assembly.

Figure 7:
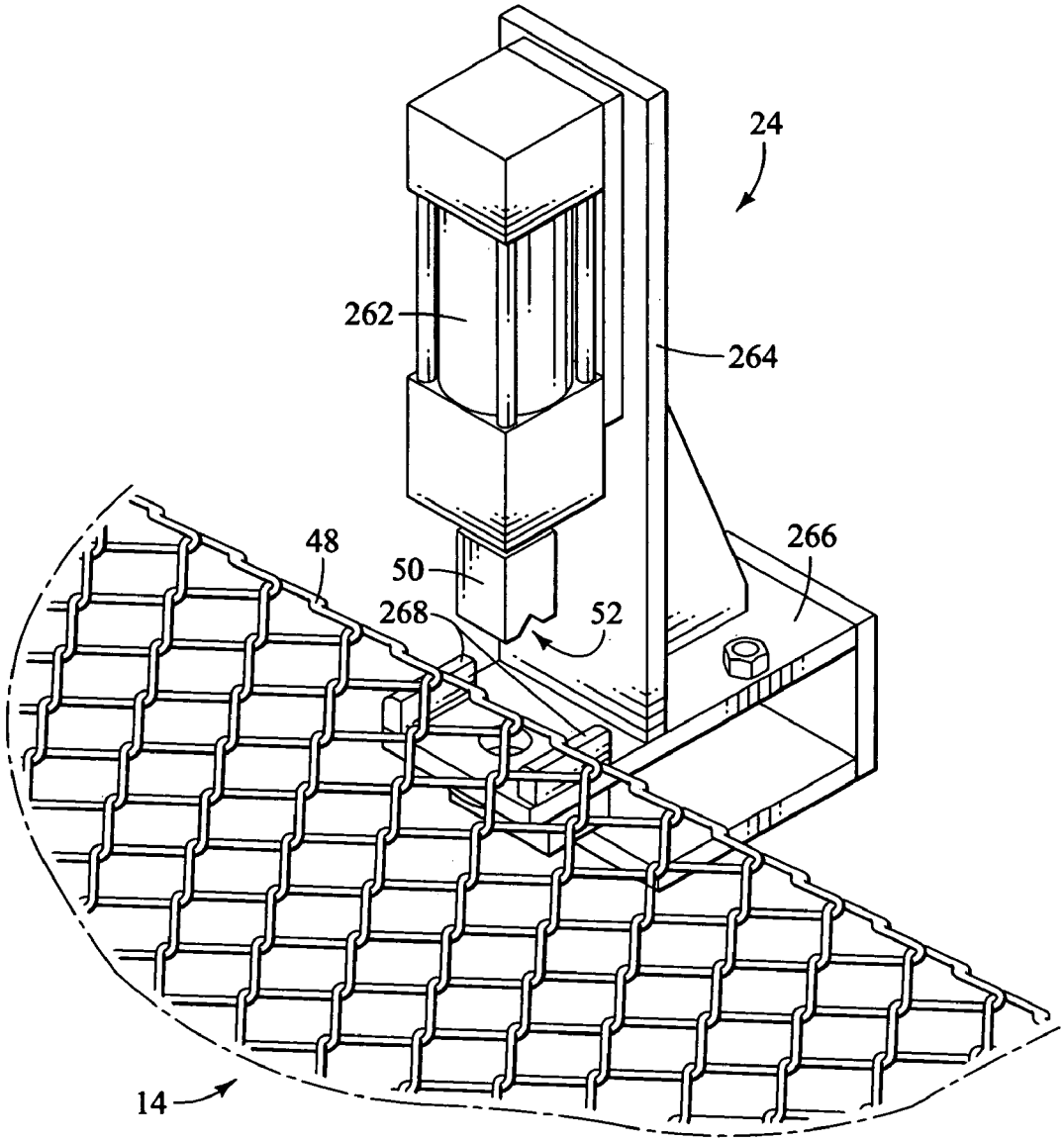
FIG. 7 is an enlarged, right, perspective view of the testing assembly shown in FIG. 1.

FIG. 7, shows, by way of example only, an enlarged view of the testing assembly 24 shown in FIG. 1. The testing assembly includes an air cylinder 262 supported by a cylinder bracket 264, which is attached to a support base 266. The testing assembly's air cylinder can be activated by a triggering device, e.g., a computer, to which the testing assembly's air cylinder is coupled. The triggering device can be located remotely from the testing assembly.

The testing assembly's air cylinder 262 pushes a block 50 having a centered triangular cutout 52 along the entire length of its bottom face toward the compressed joints 48 of the chain link fabric 14. The testing assembly also includes support brackets 268 which support the chain link fabric and hold the chain link fabric in place during testing. As discussed above, if the block travels a determined distance downward past the point of contact between the block and the welded and compressed joint of the chain link fabric, an alarm will sound and/or a visual signal will be sent to the operator, and the weaving and selvage processes will temporarily stop. This allows defective or weak connections at the welded and compressed joints to be repaired before the processed chain link fabric leaves the factory and possibly causes harm to others.

FIG. 8 shows, by way of example only, an enlarged view of the painting assembly 26 shown in FIG. 1. The painting assembly includes a cylinder mounting plate 270, which holds an air cylinder 272, a support brace 274, and a sliding gear bracket 276. The cylinder moves the support brace and the attached lower arm 278. The painting assembly's air cylinder can be activated by a triggering device, e.g., a computer, to which the air cylinder is coupled. The triggering device can be located remotely from the painting assembly.

The attached lower arm 278 is attached to a raising member 280, which raises and lowers an upper arm 282 as the lower arm 278 goes back and forth. The sliding gear basket 276 allows a paint brush 284, which is located at the end of the upper arm, to move in a circular motion, dipping into a reservoir 286 and painting the compressed joints 48 so that a coating of non-corrosive material is applied to them. In a preferred embodiment, the non-corrosive material applied to compressed joints is zinc, but any non-corrosive substance can be used. The non-corrosive material or paint can be maintained at a predetermined level within the reservoir by a counter (not shown) and a pump (not shown), which are well known in the art. The pump adds paint to the reservoir. Advantageously, the painted joints 288 have an additional layer of protection, which allows the joints to last longer. Also, the painted joints have smother edges, and thus, are less likely to cause injury to anyone who comes into contact with the edges.

Figure 16:
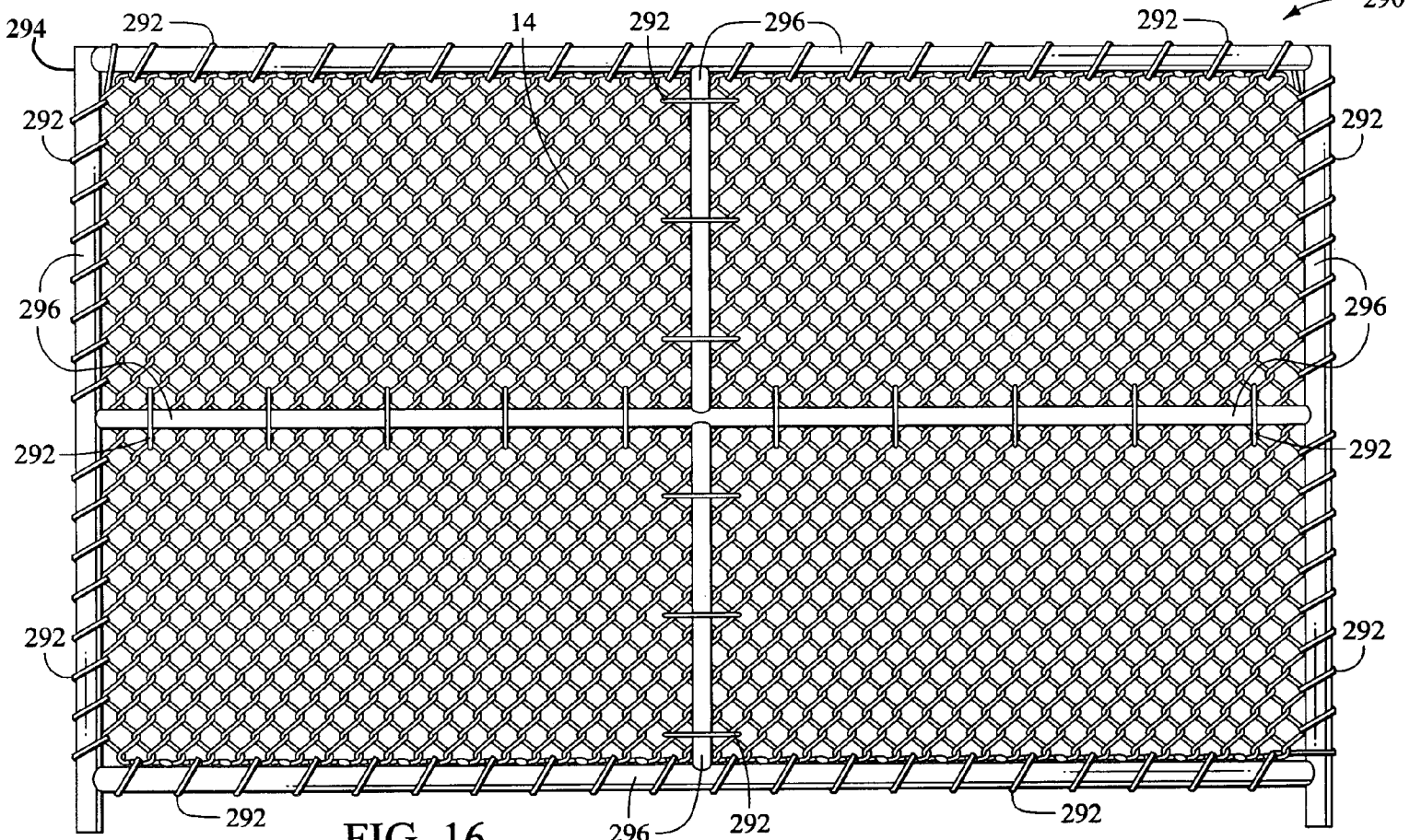
FIG. 16 is a front, elevational view of the chain link fence of the present invention.

Referring now to FIG. 16, there is shown, by way of example only, a chain link fence 290 in accordance with a preferred embodiment of the present invention. FIG. 16 shows a section of chain link fabric 14, which is attached by way of attachment members 292 to a supporting frame 294, which includes interconnected supporting members 296. Each attachment member shown in FIG. 16 is a wire that attaches the chain link fabric to one of the support members by wrapping around a portion of the fabric and the support member. In accordance with the present invention, other types of attachment members can be used, for example, metal bands and wire raps, which wrap around the chain link fabric and the support members thereby attaching the two together. In the preferred embodiment shown in FIG. 16, the support members are tubular fence frame poles that provide support for the chain link fabric.

Additionally, in accordance with the present invention, any of the wires 46 that are shown and described herein, e.g., the wires that are used in the chain link fabric 14, can be wires that are galvanized after weaving ("G.A.W") or wires that are galvanized before weaving ("G.B.W."). Wires that are not galvanized and wires that are coated with a non-corrosive material are also within the scope of the present invention.

The foregoing detailed description of the present invention is provided for the purposes of illustration, and is not intended to be exhaustive or to limit the invention to the particular embodiments disclosed. The embodiments may provide different capabilities and benefits, depending on the configuration used to implement the key features of the invention. Accordingly, the scope of the present invention is defined only by the following claims.

What is claimed is:

1. An apparatus for processing chain link fabric, the apparatus comprising a welding assembly configured to weld together wire-end portions of the chain link fabric, the welding assembly including a guiding assembly having a finger and a cam that are configured to restrict the movement of the wire-end portions while the welding assembly welds the wire-end portions together, wherein the finger and the cam are configured to move relative to the wire-end portions both before and after the wire-end portions are welded together, wherein:

the cam is configured to rotate toward the wire-end portion as the finger moves toward the wire-end portions; and the cam is configured to rotate away from the wire-end portions as the finger moves away from the wire-end portions; and wherein the guiding assembly includes a guiding assembly air cylinder, the guiding assembly includes a guiding assembly air cylinder shaft that interfaces with the guiding assembly air cylinder; and a finger block coupled between the guiding assembly air cylinder shaft and the finger; wherein the guiding assembly air cylinder in combination with the guiding assembly air shaft is configured to move the finger block and the finger relative to the wire-end portion; and wherein the finger block contacts the cam as the finger moves toward the wire-end portions causing the cam to rotate toward the wire-end portions; and the cam rotates away from the wire-end portions as the finger moves away from the wire-end portions.

2. An apparatus for processing chain link fabric, the apparatus comprising a compressing assembly configured to compress wire-end portions of the chain link fabric after the wire-end portions have been welded together, the compressing assembly including a stabilizing assembly having a stabilizing die that is configured to interface with the chain link fabric and to restrict the movement of the welded wire-end portions while the compressing assembly compresses the welded wire-end portions, wherein:

the compressing assembly further includes:

a compressing assembly air cylinder;

a compressing assembly air cylinder shaft that interfaces with the compressing assembly air cylinder;

wherein the compressing assembly air cylinder is configured to apply a force on the compressing assembly air cylinder shaft that results in the stabilizing die interfacing with the chain link fabric; and wherein the stabilizing assembly further includes a lever coupled between the stabilizing die and the compressing assembly air cylinder shaft, that is pivotably coupled to the compressing assembly; and the compressing assembly air cylinder is configured to apply a force to the compressing assembly air cylinder shaft that, in turn, moves the lever causing the stabilizing die to interface with the chain link fabric.

3. The apparatus according to claim 2, wherein the stabilizing assembly further includes a die plate that is coupled between the stabilizing die and the lever.

4. The apparatus according to claim 3, wherein:

a. the die plate has a surface;

b. the stabilizing die is coupled to the surface of the die plate; and c. a position of the stabilizing die on the surface of the die plate is adjustable.

5. The apparatus according to claim 3, wherein:

a. the compressing assembly further includes an electrode holder that is coupled to the compressing assembly air cylinder shaft;

b. the stabilizing assembly further includes an arm having a first end that is coupled to the electrode holder, and a second end that includes an arm bore;

c. a rod including:

i. a first end that is inserted through the arm bore so that the rod is slidingly coupled to the arm, and ii. a second end;

d. an eyelet mount that has a first end that is coupled to the rod's second end, and a second end;

e. wherein the lever includes:

i. a first end pivotably coupled to the eyelet mount's second end, ii. a second end that is coupled to the die plate, and iii. a lever bore located between the first end and the second end of the lever;

f. an interfacing piece having a first end that is coupled to the compressing assembly, and a second end that includes an interfacing bore; and g. a bolt positioned through the interfacing bore and the lever bore, that pivotably couples the lever to the interfacing piece.

* * * * *